US008570116B2

(12) United States Patent
Podell

(10) Patent No.: US 8,570,116 B2
(45) Date of Patent: Oct. 29, 2013

(54) POWER COMBINER/DIVIDER

(71) Applicant: Werlatone, Inc., Brewster, NY (US)

(72) Inventor: Allen F. Podell, Palo Alto, CA (US)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 13/622,788

(22) Filed: Sep. 19, 2012

(65) Prior Publication Data

US 2013/0069739 A1 Mar. 21, 2013

Related U.S. Application Data

(60) Provisional application No. 61/536,951, filed on Sep. 20, 2011.

(51) Int. Cl.
*H01P 5/12* (2006.01)
*H01P 5/10* (2006.01)

(52) U.S. Cl.
USPC ..... 333/127; 333/26

(58) Field of Classification Search
USPC ..... 333/124, 125, 127, 25, 26
See application file for complete search history.

(56) References Cited

U.S. PATENT DOCUMENTS 3,325,587 A 6/1967 Sontheimer
3,508,171 A 4/1970 Podell
4,288,762 A * 9/1981 Laughlin ..... 333/117
4,825,220 A 4/1989 Edward
5,121,090 A 6/1992 Garuts et al.
5,568,111 A * 10/1996 Metsler ..... 336/65
5,977,842 A 11/1999 Brown
5,982,252 A 11/1999 Werlau
6,285,273 B1 9/2001 Morikawa
6,750,752 B2 6/2004 Werlau
7,180,392 B2 * 2/2007 Grothen et al. ..... 333/245
7,190,240 B2 3/2007 Podell
7,692,512 B2 4/2010 Podell

OTHER PUBLICATIONS

The Southgate Amateur Radio Club (byline given as "G8MNY"); TECHTIP Coax Balun (http://www.southgatearc.org/techtips/coax_balun.htm); downloaded Aug. 3, 2007; 2 pages.
Microwave101.Com: Microwave Encyclopedia web page, "Baluns" (http://www.microwaves101.com/encyclopedia/baluns.cfm; updated Nov. 28, 2006 and downloaded Aug. 1, 2007; 3 pages.

(Continued)

*Primary Examiner* — Benny Lee
*Assistant Examiner* — Rakesh Patel
(74) *Attorney, Agent, or Firm* — Kolisch Hartwell, PC

(57) ABSTRACT

A combiner/divider may comprise a circuit ground and five transmission lines. The first transmission line may include a first conductor having a first end forming a first unbalanced-signal port relative to the circuit ground, and a second conductor having a first end connected to the circuit ground. The second and third transmission lines may be connected in parallel and each may include a conductor connecting a second end of the first conductor to a first balanced-signal port. The fourth and fifth transmission lines may be connected in parallel and each may include a conductor connecting a second end of the second conductor to a second balanced-signal port. A ferrite sleeve may surround the second and third transmission lines and/or the fourth and fifth transmission lines. The second, third, fourth and fifth transmission lines may be coaxial transmission lines with connected outer conductors.

14 Claims, 2 Drawing Sheets

(56) References Cited

OTHER PUBLICATIONS

H.T. Kim et al; "Ultra-wideband uniplaner MMIC balun using field transformations," Electronics Letters vol. 2 No. 6; Mar. 16, 2006; 2 pages.
Nai-Shuo Cheng et al; "A 120-W X-Band Spatially Combined Solid-State Amplifier," IEEE Transactions on Microwave Theory and Techniques vol. 47 No. 12 pp. 2557 through 2561; Dec. 1999; 5 pages.
Angelos Alexanian; "Planar and Distributed Spatial Power Combiners," doctoral dissertation, University of California Santa Barbara; Jun. 1997; 119 pages.
Hongming An, et al; "A 50:1 Bandwidth Cost-Effective Coupler with Sliced Coaxial Cable," IEEE MTT-S Digest, 1996; 4 pages.
Paul Horowitz et al.; "Stubs, baluns, and transformers," The Art of Electronics section 13.10, pp. 881 through 882; Second Edition Copyright 1989 Cambridge University Press; 4 pages.
Valerie Illingworth, editor; definition of the word "balun," The Penguin Dictionary of Electronics p. 30, Second Edition Copyright 1988 Penguin Books; 2 pages.
Kenneth J. Russell; "Microwave Power Combining Techniques," IEEE Transactions on Microwave Theory and Techniques vol. MTT-27 No. 5 pp. 472 through 478; May 1979; 7 pages.
C.W. Gerst; "Electrically Short 90° Couplers Utilizing Lumped Capacitors," Microwave Symposium Digest, G-MTT International vol. 67, Issue 1, pp. 58 through 62; May 1967; 5 pages.
G.D. Monteath; "Coupled Transmission Lines as Symmetrical Directional Couplers," Proc. IEE, vol. 102, Part B, No. 3, pp. 383 through 392; May 1955; 10 pages.
US Patent and Trademark Office; Office Action for U.S. Appl. No. 12/055,139; mailing date Aug. 27, 2009; 13 pages. U.S. Appl. No. 12/055,139 issued as US 7,692,512.
United Kingdom Patent Office, Combined Search and Examination Report Under Sections 17 and 18(3) regarding Application No. CB1216731.8 dated Jan. 18, 2013, 8 pages.

* cited by examiner

POWER COMBINER/DIVIDER

RELATED APPLICATION

This application claims the benefit of U.S. Provisional Application No. 61/536,951, filed Sep. 20, 2011, which application is incorporated herein by reference in its entirety for all purposes

BACKGROUND

For certain applications, such as in military applications, a broad bandwidth is required for secure spread spectrum communication and high power is required for long range. High power broadband communication systems require high power broadband antennas. Often these antennas have an input impedance that does not match the desired transmitter or receiver with which it is used. In such circumstances, baluns can be used to transform the impedance of the antenna to the impedance of the transmitter or receiver, or to convert between an unbalanced signal and a balanced signal. When large bandwidths are desired, coaxial baluns are often used. Various configurations of baluns are disclosed in U.S. Pat. Nos. 6,750,752 and 7,692,512, the disclosures of which are hereby incorporated by reference for all purposes.

Simple signal sources have two terminals, a source terminal and a return terminal, where most commonly a ground plane is used for the return path. The ground plane return simplifies circuit wiring, as a single conductor and the ground plane below form a complete signal path. The voltage on the ground plane is then the reference for this signal. Often this is referred to as an "unbalanced circuit", or "single-ended circuit". In such "unbalanced circuits" when wires cross or run parallel with one another, there can be undesired coupling.

One method for reducing such coupling is to use two wires, one carrying the signal, the other carrying the return signal, with no ground plane return path. With AC signals, either wire can be considered to carry the signal, and the other to carry the return signal. To minimize coupling to other circuits, it is highly desired that the signal current flowing in the two wires be exactly the same, and 180-degrees out of phase. That is, all of the return current for one wire of the pair is carried by the other wire, and the circuit is balanced. This guarantees that no return current is carried by the ground plane. In practice, such perfectly balanced, or differential, currents are only a theoretical goal.

An amplifier that uses balanced or differential input and output connections is less likely to have oscillations caused by input and output signals coupling, and less extraneous noise introduced by the surrounding circuitry. For this reason, practically all high gain operational amplifiers are differential. A "balun" is a coupling device that converts an unbalanced source to a balanced one, and vice versa. Sometimes a balun is made with nearly complete isolation between the balanced terminals and ground. Sometimes a balun is made with each balanced terminal referenced to ground, but with equal and opposite voltages appearing at these terminals. In the isolated case, the unbalanced voltage encounters high impedance to ground, making unbalanced current flow difficult, while in the other, any unbalanced current encounters a short circuit to ground, minimizing the voltage that enters the balanced circuit. Microwave baluns can be either of these types, or even a mixture of the two. In any case, one could connect 2 equal unbalanced loads to the 2 balanced terminals, with their ground terminals connected together to ground. Ideally, the unbalanced signal input to the balun would be equally distributed to the two unbalanced loads. Thus, a balun may be used as a power divider or combiner, where the two unbalanced loads or sources connected to the balanced terminals would be operating 180-degrees out of phase.

BRIEF SUMMARY

In one example, a combiner/divider may comprise a circuit ground and five transmission lines. The first transmission line may include a first conductor having a first end forming a first unbalanced-signal port relative to the circuit ground, and a second conductor inductively coupled to the first conductor, the second conductor having a first end connected to the circuit ground. The second transmission line may include a third conductor and a fourth conductor inductively coupled to the third conductor, the third conductor having a first end connected to a second end of the first conductor and a second end forming a first balanced-signal port. The third transmission line may include a fifth conductor and a sixth conductor inductively coupled to the third conductor. The fifth conductor may have a first end connected to the second end of the first conductor and a second end connected to the first balanced-signal port. The fourth transmission line may have a seventh conductor and an eighth conductor inductively coupled to the seventh conductor. The seventh conductor may have a first end connected to a second end of the second conductor and a second end forming a second balanced-signal port. The fifth transmission line may have a ninth conductor and a tenth conductor inductively coupled to the ninth conductor. The ninth conductor may have a first end connected to the second end of the second conductor and a second end connected to the second balanced-signal port. The fourth, sixth, eighth, and tenth conductors have their first ends connected together, and their second ends connected together. Depending on the application, there may be nothing attached to these connected first ends, and nothing attached to the connected second ends, or either the first ends or the second ends could be connected to ground, but not both as grounding both ends would short out the balun. Grounding the second ends forces the output of the balun to be voltage balanced, and is the preferred connection.

In another example, a two-way combiner/divider may comprise a circuit ground and five coaxial transmission lines. The first coaxial transmission line may include a first center conductor having a first end forming a first unbalanced-signal port relative to the circuit ground, and a first outer conductor inductively coupled to the first center conductor. The first outer conductor may have a first end connected to the circuit ground. The second coaxial transmission line may include a second center conductor and a second outer conductor inductively coupled to the second center conductor. The second center conductor may have a first end connected to a second end of the first center conductor and a second end forming a first balanced-signal port. The third coaxial transmission line may include a third center conductor and a third outer conductor inductively coupled to the second center conductor. The third center conductor may have a first end connected to the second end of the first center conductor and a second end connected to the first balanced-signal port. The fourth coaxial transmission line may have a fourth center conductor and a fourth outer conductor inductively coupled to the fourth center conductor. The fourth center conductor may have a first end connected to a second end of the first outer conductor and a second end forming a second balanced-signal port. The fifth coaxial transmission line may have a fifth center conductor and a fifth outer conductor inductively coupled to the fifth center conductor. The fifth center conductor may have a first end connected to the second end of the first outer conductor and a second end connected to the second balanced-signal port. The second, third, fourth, and fifth outer conductors have their first ends connected together, and their second ends connected together. Depending on the application, there may be nothing attached to these connected first ends, and nothing attached to the connected second ends, or either the first ends or second ends could be connected to ground, but not both.

DETAILED DESCRIPTION

Figure 1:
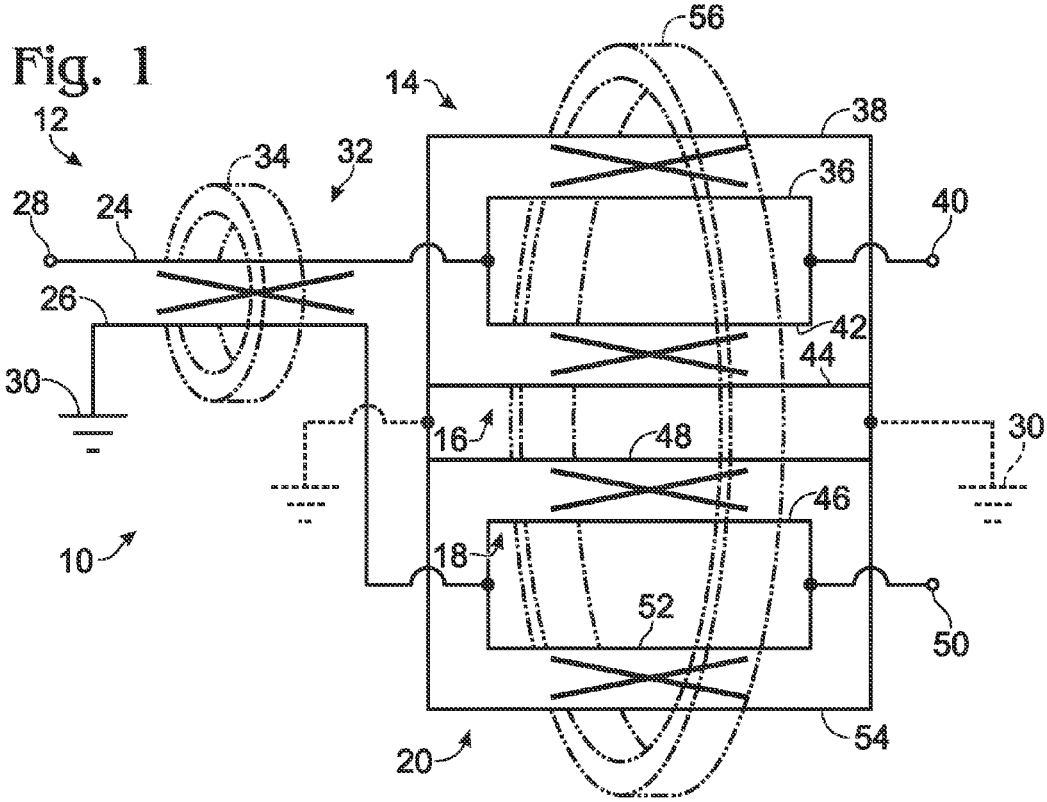
FIG. 1 is a diagram of an example a divider/combiner.

Referring to FIG. 1, a combiner/divider is shown generally at 10. A combiner/divider may also be referred to as a combiner/divider circuit, a divider/combiner, a divider, or a combiner, it being understood that signals and power may be conducted in either direction through them to either combine multiple inputs into a single output or to divide a single input into multiple outputs.

Combiner/divider 10 may include a plurality of transmission lines, including a first transmission line 12, a second transmission line 14, a third transmission line 16, a fourth transmission line 18, and a fifth transmission line 20. Each one of these transmission lines may be constructed as one of various forms well known in the art. For example, a transmission line may be a coaxial transmission line, twisted pair, strip line, coplanar waveguide, slot line, or microstrip line. Whatever the form, each transmission line may include a pair of electrically spaced apart, inductively coupled conductors that conduct or transmit a signal defined by a voltage difference between the conductors.

Transmission line 12 may include a first conductor 24 and a second conductor 26. A first end of first conductor 24 may be connected to or form an unbalanced port 28. Each port may be a place where characteristics of combiner/divider 10 may be defined, whether accessible or not. A corresponding first end of second conductor 26 may be connected to a circuit ground 30. Transmission line 12 may be a balun 32, having balanced signals on respective second ends of conductors 24 and 26. Transmission line 12 further may be wrapped on or pass through a ferrite core or sleeve 34.

Second transmission line 14 may include a third conductor 36 and a fourth conductor 38 that are inductively coupled together. A first end of third conductor 36 may have a first end connected to the second end of first conductor 24, as shown. A second end of conductor 36 forms or is connected to a first balanced-signal port 40.

In this example, third transmission line 16 includes a fifth conductor 42 and a sixth conductor 44 that are inductively coupled together. The fifth conductor has a first end connected to the second end of first conductor 24, and thereby to the first end of the third conductor. A second end of conductor 42 is also connected to first balanced-signal port 40 and thereby to conductor 36 since the signals on conductors 36 and 42 are in phase. The respective ends of conductors 38 and 44 may be connected together. Further, either of the ends of conductors 38 and 44 may be connected to circuit ground 30. FIG. 1 shows that the ends proximate to port 40 may be connected to circuit ground.

Fourth transmission line 18 may have a seventh conductor 46 and an eighth conductor 48 inductively coupled together. The seventh conductor may have a first end connected to a second end of second conductor 26 and a second end may form or be connected to a second balanced-signal port 50.

Fifth transmission line 20 in this example has a ninth conductor 52 that is inductively coupled to a tenth conductor 54. A first end of the ninth conductor may be connected to the second end of second conductor 26, and a second end may be connected to second balanced-signal port 50, and thereby to conductor 46 since the signals on conductors 46 and 52 are in phase. The respective ends of conductors 48 and 54 may be connected together. Further, either of the ends of conductors 48 and 54 may be connected to circuit ground 30. In this example, the respective ends of conductors 38, 44, 48, and 54 may be connected together, as shown.

One or more of transmission lines 14, 16, 18, and 20 may pass through or be coiled around a ferrite core or sleeve 56. In this example, all four transmission lines 14, 16, 18, and 20 may pass through ferrite sleeve 56.

It is seen that second and third transmission lines 14 and 16 are connected in parallel between first conductor 24 of transmission line 12 and port 40, and fourth and fifth transmission lines 18 and 20 are connected in parallel between second conductor 26 of transmission line 12 and port 50. If the five transmission lines are all 50-ohm (R) lines, then the parallel combination of transmission lines 14 and 16 appears as a 25-ohm (R/2) impedance on first conductor 24 of transmission line 12, and the parallel combination of transmission lines 18 and 20 appears as a 25-ohm (R/2) impedance on second conductor 26. The result is that the two parallel combinations of transmission lines, each having an impedance of 25 ohms (R/2), provide a series impedance of 50 ohms (R/2+R/2) across the second ends of conductors 24 and 26 of transmission line 12. Conducting a signal over plural lines spreads out loss that would otherwise be dissipated by a single transmission line and allows for increased power to be carried by the combination of transmission lines.

Figure 2:
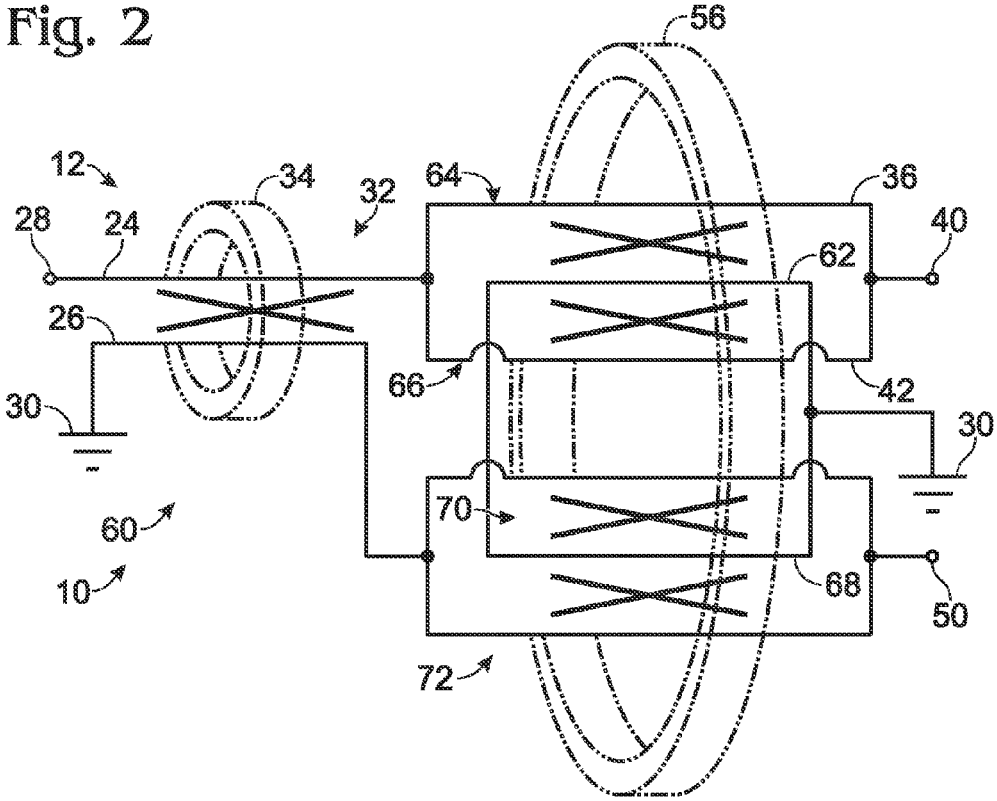
FIG. 2 is a diagram of another example of a divider/combiner.

A variation of combiner/divider 10 is shown as a combiner/divider 60 in FIG. 2. Elements of combiner/divider 60 that may be the same as those of combiner/divider 10 are shown with the same reference numbers, and the description with reference to combiner/divider 10 applies. Combiner/divider 60 varies from combiner/divider 10 in that instead of having separate conductors 38 and 44, a combined conductor 62 is inductively coupled to conductors 36 and 42, forming second and third transmission lines 64 and 66. Similarly, a combined conductor 68 is inductively coupled to conductors 46 and 52, forming fourth and fifth transmission lines 70 and 72. The respective ends of combined conductors 62 and 68 are connected together, and the ends of conductors 62 and 68 proximate to ports 40 and 50 are also connected to circuit ground 30. Otherwise, combiner/divider 60 functions like and is more compact than combiner/divider 10 discussed above.

Figure 3:
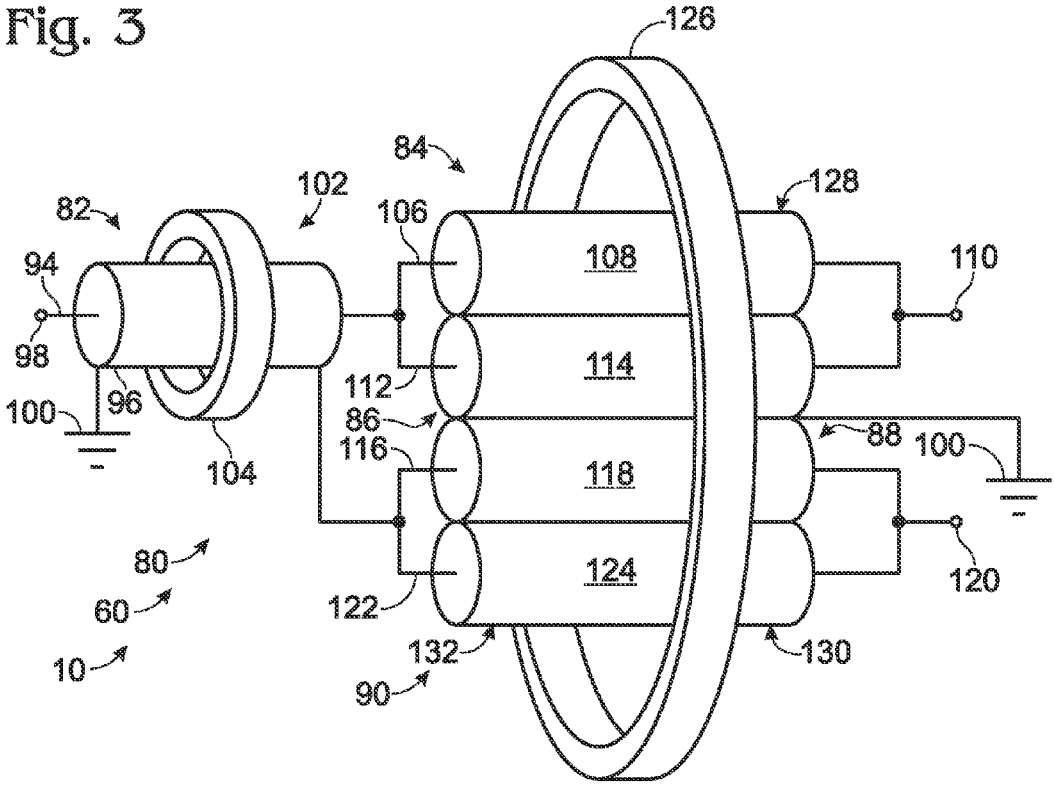
FIG. 3 is a diagram of an example of a power divider/combiner having coaxial transmission lines.

Referring to FIG. 3, a combiner/divider shown generally at 80 may be an example of a combiner/divider 10 or a combiner/divider 60. Combiner/divider 80 may include a plurality of coaxial transmission lines, including a first coaxial transmission line 82, a second coaxial transmission line 84, a third coaxial transmission line 86, a fourth coaxial transmission line 88, and a fifth coaxial transmission line 90.

Coaxial transmission line 82 may include a first center conductor 94 and a first shield or outer conductor 96. A first end of first center conductor 94 may be connected to or form an unbalanced port 98. A corresponding first end of first outer conductor 96 may be connected to a circuit ground 100. Coaxial transmission line 82 may be a balun 102 having balanced signals on respective second ends of conductors 94 and 96. Coaxial transmission line 82 further may be wrapped on or pass through a ferrite core or sleeve 104.

Second coaxial transmission line 84 may include a second center conductor 106 and a second outer conductor 108 that are inductively coupled together. A first end of second center conductor 106 may have a first end connected to the second end of first center conductor 94, as shown. A second end of conductor 106 forms or is connected to a first balanced-signal port 110.

In this example, third coaxial transmission line 86 includes a third center conductor 112 and a third outer conductor 114 that are inductively coupled together. The third center conductor has a first end connected to the second end of first center conductor 94, and thereby to the first end of the second center conductor. A second end of conductor 112 is also connected to first balanced-signal port 110, and thereby to conductor 106 since the signals on conductors 106 and 112 are in phase. The respective ends of conductors 108 and 114 may be connected together. Further, the ends of conductors 108 and 114 proximate to port 110 may be connected to circuit ground 100.

Fourth coaxial transmission line 88 may have a fourth center conductor 116 and a fourth outer conductor 118 inductively coupled together. The fourth center conductor may have a first end connected to a second end of first outer conductor 96 and a second end may form or be connected to a second balanced-signal port 120.

Fifth coaxial transmission line 90 in this example has a fifth center conductor 122 that is inductively coupled to a fifth outer conductor 124. A first end of the fifth center conductor may be connected to the second end of first outer conductor 96, and a second end may be connected to second balanced-signal port 120, and thereby to conductor 116 since the signals on conductors 116 and 122 are in phase. The respective ends of conductors 118 and 124 may be connected together. Further, the ends of conductors 118 and 124 proximate to port 120 may be connected to circuit ground 100 or the ends of conductors 118 and 124 distal from port 120 may be connected to circuit ground. In this example, the respective ends of conductors 108, 114, 118, and 124 may be connected together, as shown. If convenient, the outer conductors of the second, third, fourth and fifth coaxial transmission lines may be connected together over their entire lengths.

One or more of coaxial transmission lines 84, 86, 88, and 90 may pass through or be coiled around a ferrite core or sleeve 126. In this example, all four coaxial transmission lines 84, 86, 88, and 90 may pass through ferrite sleeve 126.

As with combiner/divider 10, second and third coaxial transmission lines 84 and 86 are connected in parallel between first conductor 94 of coaxial transmission line 82 and port 110, and fourth and fifth coaxial transmission lines 88 and 90 are connected in parallel between second conductor 96 of coaxial transmission line 82 and port 120. If the five coaxial transmission lines are all 50-ohm (R) lines, then the parallel combination of coaxial transmission lines 84 and 86 appears as a 25-ohm (R/2) impedance on first conductor 24 of coaxial transmission line 82, and the parallel combination of coaxial transmission lines 88 and 90 appears as a 25-ohm (R/2) impedance on second conductor 96. The result is that the two parallel combinations of coaxial transmission lines, each having an impedance of 25 ohms (R/2), provide a series impedance of 50 ohms (R/2+R/2) across the second ends of conductors 94 and 96 of coaxial transmission line 82. Conducting a signal over plural lines spreads out loss that would otherwise be dissipated by a single coaxial transmission line and allows for increased power to be carried by the combination of coaxial transmission lines.

In some examples, the transmission lines 84, 86, 88, and 90 may have the shields or outer conductors connected together at both ends, and the shields of the transmission lines may all be connected together along their lengths. The shields may be connected to ground at either of the ends. In this example the ends associated with the divided ports, such as ports 110 and 120, are connected to ground. In this example, the second and third outer conductors are connected along the lengths of the outer conductors and form what may be considered a single first combined outer conductor 128. Similarly, the fourth and fifth outer conductors are connected along the lengths of the outer conductors and form a single second combined outer conductor 130. The two combined outer conductor pairs are connected at both ends, and may also be connected along the full length of these four lines to form a single combined outer conductor 132, also referred to generally as a single combined conductor, for all four transmission lines.

Loss for coaxial transmission lines at high frequencies may be dominated by skin effect, and the loss in the transmission line may be inversely related to its diameter. Thus for example, a transmission line X may dissipate 1% of the input power at a high frequency, say 250 MHz. Another transmission line Y that is half the diameter of X may dissipate 2% of the input power. When one connects four such Y coaxial transmission lines together as described above, the input power passes through four transmission lines, and dissipates 2% of the input power, but the dissipation is spread over four transmission lines. Each then dissipates 0.5% of the input power, with a corresponding decrease in temperature rise to half that of the larger coaxial transmission line. Moreover, the four-wire transmission line may be much more flexible than a higher-power but larger diameter transmission line. The smaller diameter transmission lines may be more readily wrapped around a ferrite or other core. Various other series and parallel combinations and different characteristic impedances may be used for a given application of the power divider/combiner.

From the above description, it will be appreciated that a combiner/divider may comprise a circuit ground and five transmission lines. The first transmission line may include a first conductor having a first end forming a first unbalanced-signal port relative to the circuit ground, and a second conductor inductively coupled to the first conductor, the second conductor having a first end connected to the circuit ground. The second transmission line may include a third conductor and a fourth conductor inductively coupled to the third conductor, the third conductor having a first end connected to a second end of the first conductor and a second end forming a first balanced-signal port. The third transmission line may include a fifth conductor and a sixth conductor inductively coupled to the third conductor. The fifth conductor may have a first end connected to the second end of the first conductor and a second end connected to the first balanced-signal port. The fourth transmission line may have a seventh conductor and an eighth conductor inductively coupled to the seventh conductor. The seventh conductor may have a first end connected to a second end of the second conductor and a second end forming a second balanced-signal port. The fifth transmission line may have a ninth conductor and a tenth conductor inductively coupled to the ninth conductor. The ninth conductor may have a first end connected to the second end of the second conductor and a second end connected to the second balanced-signal port.

The fourth, sixth, eighth, and tenth conductors may have respective first ends connected together. In this example, the respective second ends of the fourth, sixth, eighth, and tenth conductors are connected to ground.

A ferrite sleeve may surround the second, third, fourth, and fifth transmission lines. The fourth, sixth, eighth, and tenth conductors may be connected along their lengths forming a single combined conductor.

In other examples, a two-way combiner/divider may comprise a circuit ground and five coaxial transmission lines. The first coaxial transmission line may include a first center conductor having a first end forming a first unbalanced-signal port relative to the circuit ground, and a first outer conductor inductively coupled to the first center conductor. The first outer conductor may have a first end connected to the circuit ground. The second coaxial transmission line may include a second center conductor and a second outer conductor inductively coupled to the second center conductor. The second center conductor may have a first end connected to a second end of the first center conductor and a second end forming a first balanced-signal port. The third coaxial transmission line may include a third center conductor and a third outer conductor inductively coupled to the second center conductor. The third center conductor may have a first end connected to the second end of the first center conductor and a second end connected to the first balanced-signal port. The fourth coaxial transmission line may have a fourth center conductor and a fourth outer conductor inductively coupled to the fourth center conductor. The fourth center conductor may have a first end connected to a second end of the first outer conductor and a second end forming a second balanced-signal port. The fifth coaxial transmission line may have a fifth center conductor and a fifth outer conductor inductively coupled to the fifth center conductor. The fifth center conductor may have a first end connected to the second end of the first outer conductor and a second end connected to the second balanced-signal port.

The second, third, fourth, and fifth outer conductors may have respective first ends connected together and have respective second ends connected together and to circuit ground.

A ferrite sleeve may surround the second, third, fourth, and fifth coaxial transmission lines.

The second, third, fourth, and fifth outer conductors may be connected along their lengths forming a single combined outer conductor.

The above description is intended to be illustrative, and not restrictive. Many other embodiments will be apparent to those of skill in the art upon reviewing the above description. The scope of the invention should, therefore, be determined with reference to any subsequently appended claims, along with the full scope of equivalents to which such claims are entitled. Accordingly, while embodiments of baluns, couplers, and combiner/dividers have been particularly shown and described, many variations may be made therein. This disclosure may include one or more independent or interdependent inventions directed to various combinations of features, functions, elements and/or properties, one or more of which may be defined in the claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

INDUSTRIAL APPLICABILITY

The methods and apparatus described in the present disclosure are applicable to telecommunications, signal processing systems, and other applications in which radio-frequency devices and circuits are used.

What is claimed is:

1. A combiner/divider comprising:

a circuit ground;

a first transmission line including a first conductor having a first end forming a first unbalanced-signal port relative to the circuit ground, and a second conductor inductively coupled to the first conductor, the second conductor having a first end directly connected to the circuit ground;

a second transmission line including a third conductor and a fourth conductor inductively coupled to the third conductor, the third conductor having a first end directly connected to a second end of the first conductor and a second end forming a first balanced-signal port;

a third transmission line including a fifth conductor and a sixth conductor inductively coupled to the fifth conductor, the fifth conductor having a first end directly connected to the second end of the first conductor and a second end connected to the first balanced-signal port;

a fourth transmission line having a seventh conductor and an eighth conductor inductively coupled to the seventh conductor, the seventh conductor having a first end directly connected to a second end of the second conductor and a second end forming a second balanced-signal port; and a fifth transmission line having a ninth conductor and a tenth conductor inductively coupled to the ninth conductor, the ninth conductor having a first end directly connected to the second end of the second conductor and a second end directly connected to the second balanced-signal port;

the fourth, sixth, eighth, and tenth conductors having respective first ends directly connected together and respective second ends directly connected together.

2. A combiner/divider according to claim 1, wherein either the respective first ends or the second respective ends of the fourth, sixth, eighth, and tenth conductors are directly connected to circuit ground.

3. A combiner/divider according to claim 2, wherein the respective second ends of the fourth, sixth, eighth, and tenth conductors are proximate the respective second ends of the third, fifth, seventh, and ninth conductors, and the respective second ends of the fourth, sixth, eighth, and tenth conductors are directly connected to circuit ground.

4. A combiner/divider according to claim 1, further comprising a ferrite sleeve surrounding the second and third transmission lines.

5. A combiner/divider according to claim 4, wherein the ferrite sleeve also surrounds the fourth and fifth transmission lines.

6. A combiner/divider according to claim 1, wherein the fourth and sixth conductors are connected along their lengths forming a single combined conductor.

7. A combiner/divider according to claim 1, wherein the fourth, sixth, eighth, and tenth conductors are connected along their lengths forming a single combined conductor.

8. A two-way combiner/divider comprising:

a circuit ground;

a first coaxial transmission line including a first center conductor having a first end forming a first unbalanced-signal port relative to the circuit ground, and a first outer conductor inductively coupled to the first center conductor, the first outer conductor having a first end directly connected to the circuit ground;

a second coaxial transmission line including a second center conductor and a second outer conductor inductively coupled to the second center conductor, the second center conductor having a first end directly connected to a second end of the first center conductor and a second end forming a first balanced-signal port;

a third coaxial transmission line including a third center conductor and a third outer conductor inductively coupled to the third center conductor, the third center conductor having a first end directly connected to the second end of the first center conductor and a second end connected to the first balanced-signal port;

a fourth coaxial transmission line having a fourth center conductor and a fourth outer conductor inductively coupled to the fourth center conductor, the fourth center conductor having a first end directly connected to a second end of the first outer conductor and a second end forming a second balanced-signal port; and a fifth coaxial transmission line having a fifth center conductor and a fifth outer conductor inductively coupled to the fifth center conductor, the fifth center conductor having a first end directly connected to the second end of the first outer conductor and a second end directly connected to the second balanced-signal port;

the second, third, fourth, and fifth outer conductors having respective first ends directly connected together and respective second ends directly connected together.

9. A combiner/divider according to claim 8, wherein either the respective first ends or the second respective ends of the second, third, fourth, and fifth outer conductors are directly connected to circuit ground.

10. A combiner/divider according to claim 9, wherein the respective second ends of the second, third, fourth, and fifth outer conductors are proximate the respective second ends of the second, third, fourth, and fifth center conductors, and the respective second ends of the second, third, fourth, and fifth outer conductors are directly connected to circuit ground.

11. A combiner/divider according to claim 8, further comprising a ferrite sleeve surrounding the second and third coaxial transmission lines.

12. A combiner/divider according to claim 11, wherein the ferrite sleeve also surrounds the fourth and fifth coaxial transmission lines.

13. A combiner/divider according to claim 8, wherein the second and third outer conductors are connected along their lengths forming a single combined outer conductor.

14. A combiner/divider according to claim 8, wherein the second, third, fourth, and fifth outer conductors are connected along their lengths forming a single combined outer conductor.

* * * * *